United States Patent [19]

Spindt

[11] Patent Number: 4,926,056

[45] Date of Patent: May 15, 1990

[54] MICROELECTRONIC FIELD IONIZER AND METHOD OF FABRICATING THE SAME

[75] Inventor: Charles A. Spindt, Menlo Park, Calif.

[73] Assignee: SRI International, Menlo Park, Calif.

[21] Appl. No.: 205,191

[22] Filed: Jun. 10, 1988

[51] Int. Cl.[5] ..... H01J 27/02

[52] U.S. Cl. ..... 250/423 F; 164/46; 313/230; 313/362.1

[58] Field of Search ..... 250/423 R, 423 P, 423 F, 250/425, 285; 164/46; 264/81; 313/230, 429, 362.1; 239/704

[56] References Cited

U.S. PATENT DOCUMENTS

| | | | |
|---|---|---|---|
| 3,665,241 | 5/1972 | Spinot et al. | 250/423 R |
| 3,852,595 | 12/1974 | Aberth | 250/423 F |
| 3,970,887 | 7/1976 | Smith et al. | 313/309 |
| 4,008,412 | 2/1977 | Yuito et al. | 313/309 |
| 4,095,133 | 6/1978 | Hoeberechts | 313/336 |
| 4,141,405 | 2/1979 | Spindt | 164/46 |
| 4,193,836 | 3/1980 | Youmans et al. | 156/657 |
| 4,205,418 | 6/1980 | Przybylek | 29/25.18 |
| 4,253,221 | 3/1981 | Cochran, Jr. et al. | 29/25.18 |
| 4,307,507 | 12/1981 | Gray et al. | 29/580 |

*Primary Examiner*—Jack I. Berman

*Attorney, Agent, or Firm*—Flehr, Hohbach, Test, Albritton & Herbert

[57] ABSTRACT

A microelectronic field ionizer and alternate fabrication procedures for the same are described. The field ionizer has an array of small diameter gas outlets in the form of microvolcanos. A counterelectrode layer of material is provided on the microelectronic substrate, in the registration with the gas outlets.

15 Claims, 4 Drawing Sheets

MICROELECTRONIC FIELD IONIZER AND METHOD OF FABRICATING THE SAME

DISCLOSURE

BACKGROUND OF THE INVENTION

The present invention relates to field ionization and, more particularly, to a microelectronic field ionizer structure and a method of fabricating the same.

There are two fundamentally different approaches to ionizing atoms or molecules of a gas or the like. In the first approach, bombardment or other energetic particle interaction with the molecules of the gas of interest is used to strip off electrons. This approach, often called "hard" ionization, can result in appreciable undesired particle interaction with the gas molecules, resulting in fundamental changes in the nature of the positive ions formed by the procedure.

The second approach, often referred to as "soft ionization", relies on interaction with the gas atoms to be ionized, of an electrostatic field rather than particles. The advantage of this approach is that it is less likely that the interaction between the field and the molecules or atoms to be ionized will result in nuclei changes. The paper published in the *International Journal of Mass Spectroscopy,* entitled "Characteristics of a Volcano Field Quadruple Mass Spectrometer" by C. A. Spindt, the inventor hereof, and W. Aberth, discloses a field ionization source which uses a volcano-like cathode to effect the desired ionization. U.S. Pat. No. 4,141,405 naming the applicant as the inventor, describes a method of fabricating a hollow volcano cathode for use in such an ionization source. Gas to be ionized is passed through the cone of the cathode. When an appropriately high voltage is applied between the cone and a nearby counterelectrode, a high electrostatic field is created at the sharp rim at the end of the hollow cone to ionize gas in its region. Thus, passage of a gas to be ionized through the cone results in the desired ionization.

The counterelectrode of such a structure typically is a separate screen having small circular openings which register with a volcano shaped cone through which the gas is passed.

Volcano field ionizers have been made relatively small in the past. For example, in operable embodiments the sharp rims of volcanos themselves have had a diameter of about 20 microns and have been centered in about 60 micron diameter circular screen openings positioned in the plane of the rims. With such a construction, there is a spacing of nominally 40 microns between the edge of the cone and the counterelectrode screen opening. Operating voltages in the range of 1000–2000 volts are required to create the electrostatic field necessary at the sharp rim of the cone to effect the desired gas ionization. It has been found that in order to prevent electrical breakdown between the counterelectrode screen and the cone at such high voltages, it is necessary that such ionizers be operated within a relatively high vacuum, e.g., $10^{-4}$ torr or better.

SUMMARY OF THE INVENTION

The present invention is a microelectronic field ionizer, i.e., one which is fabricated with the techniques typically used to fabricate integrated circuitry, and a method of fabricating the same. The counterelectrode for the source is a layer of conductive material which is provided on the very same structure which defines the volcano. It has been found that the dimensions between the counterelectrode and the gas outlet can be made so small that a relatively low voltage differential can be used to form a sufficient electrostatic field for ionization. Moreover, this has been found that it can be done without an electrical breakdown being caused between the counterelectrode and the cone.

As mentioned previously, the microelectronic ionizer of the invention is fabricated using the same technology now commonly used to manufacture integrated circuitry. That is, it includes a planer substrate, typically a semiconductive one, on one surface of which a gas outlet is formed and to which an electrically conductive material is applied to form the counterelectrode. As will be described hereinafter, an appropriate insulating layer also is formed on the substrate to assure that electrical leakage through the structure of the required potential difference between the counterelectrode and the material forming the gas outlet, will be inhibited.

It has been found to be preferable to form the relatively sharp rim at the gas outlet responsible for ionization from the opposite side of a substrate, through an aperture to the location desired for the gas outlet. As will become clearer hereinafter, such a construction enables one to "taper" to an edge, deposition on the substrate of a conductive layer that will form the sharp rim.

Other advantages and features of the invention will become apparent or will be described in connection with the following, more detailed description.

BRIEF DESCRIPTION OF THE DRAWINGS

With reference to the accompanying drawings.

DETAILED DESCRIPTION OF THE DRAWINGS

Figure 1:
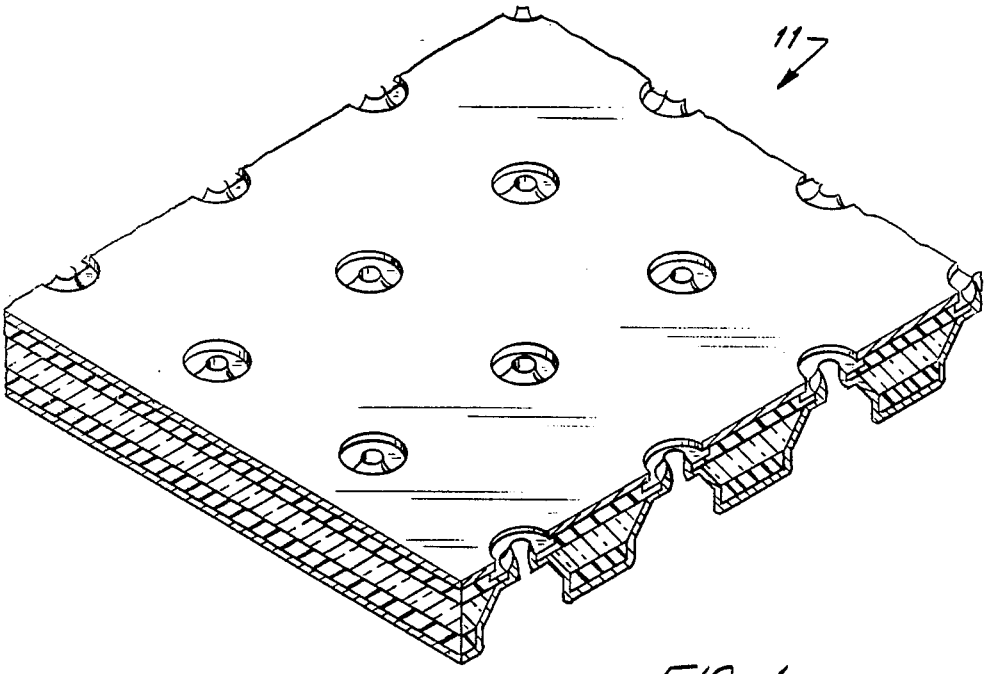
FIG. 1 is a magnified, perspective view of a portion of an array of microelectronic field ionizers of a preferred embodiment of the invention.

FIG. 1 illustrates a portion 11 of an array of microelectronic field ionizers of the invention. (The adjective "microelectronic" is used to identify the ionizer as being made by fabrication techniques of the type used to make integrated circuitry.) An array of ionizers provides a significant increase in ion current density over that which is provided by an individual ionizer having the same parameters. Preferably, the ionizers of the array are approximately six microns apart, center to center, when they have the dimensions and other parameters set forth below.

Figure 2:
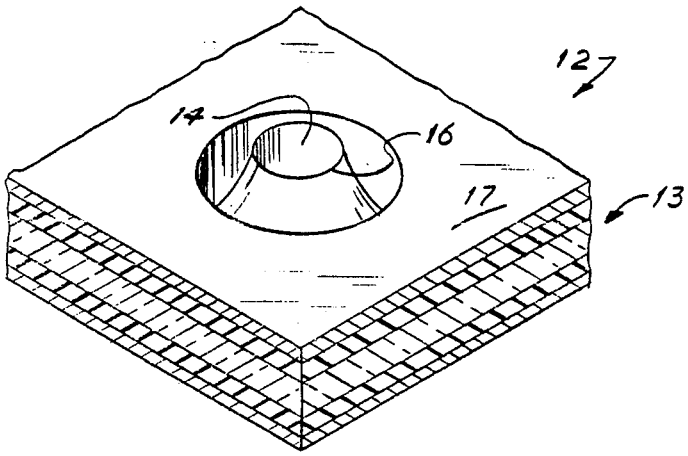
FIG. 2 is an enlarged, perspective view of a single field ionizer of FIG. 1.

FIG. 2 illustrates a single microelectronic field ionizer 12 of the invention. As illustrated, it includes a planer substrate 13 having at its upper surface a gas outlet 14. As will be explained in more detail hereinafter, gas outlet 14 is defined by a layer of an electrically conductive material capable of maintaining an electrical potential. It terminates in a sharp annular rim or edge 16 at which a high electrostatic field is generated for ionizing gas passing therethrough.

In keeping with the invention, the ionizer also includes another electrically conductive material 17 on the substrate adjacent the outlet. This material is applied in the form of a layer and provides a counterelectrode so that a potential difference can be established at the gas outlet to create the desired electrostatic field.

The annular rim has a thickness of less than about 1000 Å preferably of about 500 Å. It is spaced in the range of about one tenth micron to one micron, preferably about 5000 Å, from the counterelectrode. (This is the closest uninsulated spacing between the outlet and the counterelectrode.) With the preferred construction, a potential difference of between about 75 V and 150 V will provide an electrostatic field at the outlet which will cause ionization with adequate efficiency of most gasses of interest passed through it. In this connection, the gas outlet has a diameter in the range of one-tenth to one micron, preferably about 5000 Å. This results in the electrostatic field maintaining basically the same strength across the full throughput area, thereby increasing the efficiency of ionization.

Figure 3:
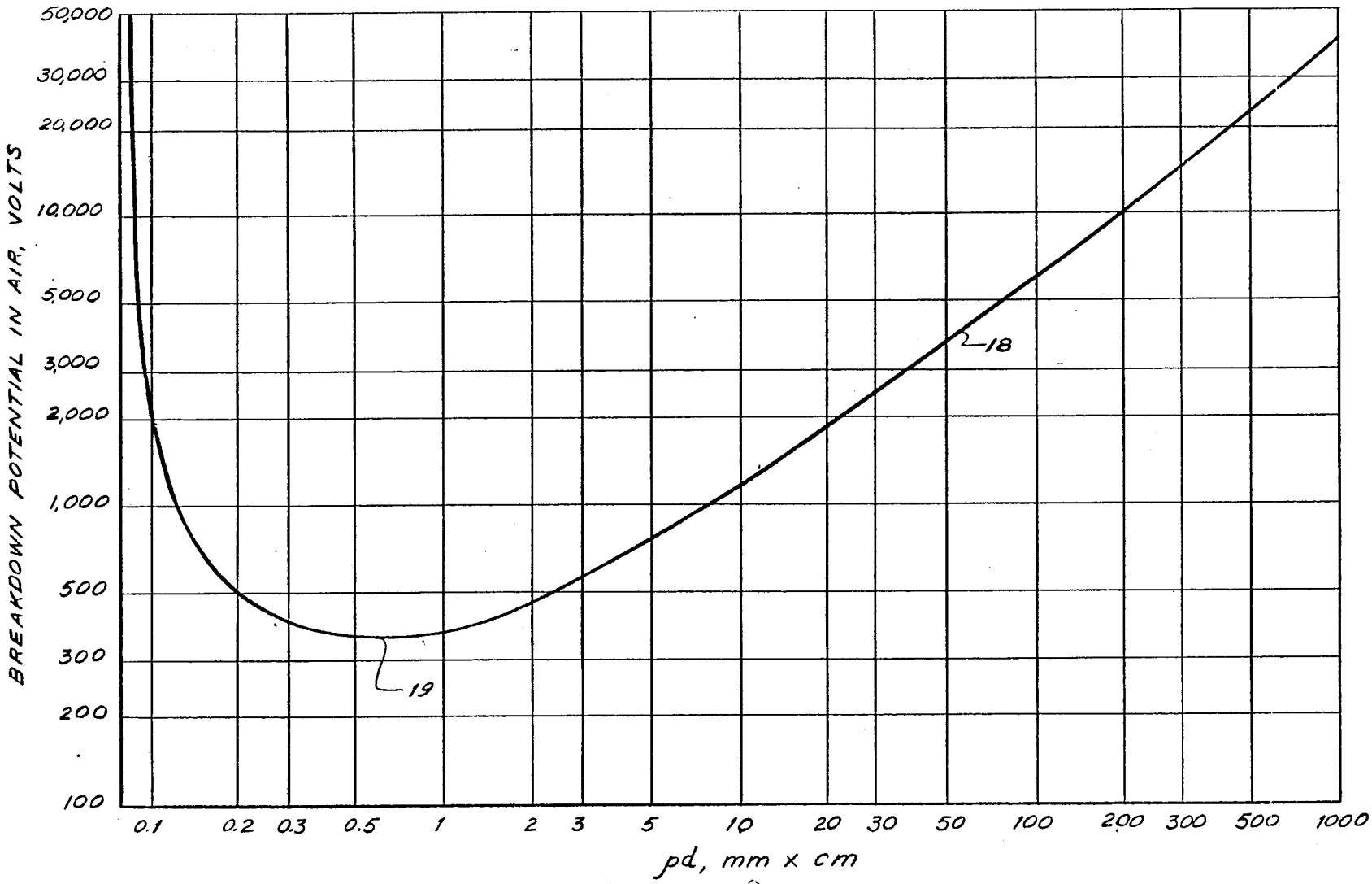
FIG. 3 is a curve defining the relationship of electrical breakdown potential in air to electrode spacing and air pressure.

A major advantage of the ionizer of the invention is that it can be used in higher ambient pressures without electrical breakdown. That is, even though the spacing between the counterelectrode and gas outlet is quite small, electrical breakdown is inhibited irrespective of the pressure of the gases within the space provided certain dimensional relationships are maintained: for an understanding of this, reference is made to FIG. 3. FIG. 3 illustrates in graph form, the relationship between the potential difference required for breakdown in air to occur and the air pressure x electrode spacing (pd), on logarithmic scales. Curve 18 shows such relationship and, as illustrated, includes a minimum 19 at about 350 volts, i.e., the breakdown potential increases when the pd product is less than about 0.7. (It will be recognized that the constituent nature of the gas between the electrodes of interest plays a great role in defining the breakdown potential. As a general rule, the curve defining the breakdown potential v-pd relationship in a gas will have the general shape of curve 18.)

It will be seen from the FIG. 3 graph, that it is important that the spacing between the counterelectrode and gas outlet be such that the operating point (v, pd) falls below curve 18 to avoid deleterious electrical breakdown between the counterelectrode and the gas outlet when the ionizer is operating. The close interelectrode spacing achievable with the instant invention places this operating point to the Y axis side of the minimum 19, with the result that a relatively high potential difference can be applied without consequent breakdown. However, the interelectrode spacing is so close that the high electrostatic field that is necessary at the gas outlet can be obtained with the application of a relatively low voltage, i.e., less than 300 volts. As is seen from the graph, with such low voltage electrical breakdown is prevented in air irrespective of the pressure of such air. That is, the voltage is sufficiently low that the operating point always will be below the minimum 19 illustrated, irrespective of the value of pd.

Figure 4:
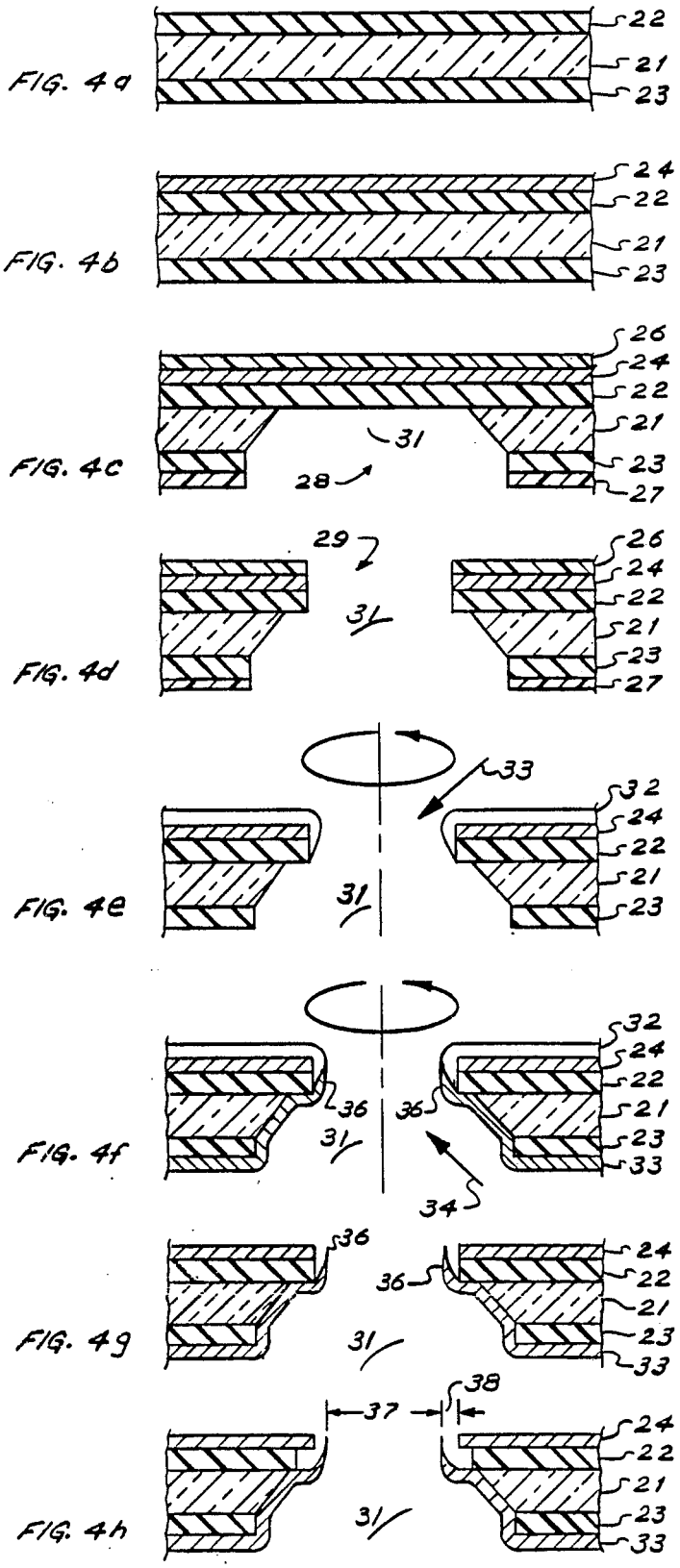
FIGS. 4*a* to 4*h* are sequential views of processing steps in the fabrication of a microelectronic field ionizer.

The preferred method by which the low voltage, microelectronic field ionizer of the invention is fabricated will be best understood with reference to FIG. 4. The method will be described in connection with the production of a single ionizer, although it will be recognized that an array of the ionizers will be produced on the substrate simultaneously as shown in FIG. 1. This single ionizer is illustrated greatly magnified and broken away, and for ease of description out of scale.

With reference to FIG. 4*a*, an appropriate substrate 21, preferably a monocrystalline silicon wafer, is provided. The crystal orientation of the wafer is selected to enable anisotropic etching of the same as will be described hereinafter.

Insulating layers 22 and 23 are provided on the exposed surfaces of the substrate. If the substrate is silicon, silicon dioxide insulating layers can be produced by heat treating the substrate in an air furnace at a temperature of about 1100° C. for 24 hours. The exposed surfaces of the substrate will be oxidized to a depth of about 1.75 μm (micrometers), assuming the silicon wafer is free of contaminants at such surfaces.

The surface of the substrate having the oxidation layer 22 is the surface at which the volcano gas outlets are to be formed. A layer of an electrically conductive metal is applied to such surface over the insulating layer 22. This layer of metal will form the counterelectrode and is represented in FIG. 4*b* at 24. It can be, for example, chromium applied by vacuum evaporation to a thickness of about 5000 Å.

A suitable resist material which will act as a protective layer to control etching or other removal of oxide layer 23 is applied to such layer. This resist is represented in FIG. 4*c* as layer 27. Such a resist is also applied to metal layer 24, as is represented in FIG. 4*c* at 26.

Resist 27 is patterned and exposed using conventional photolithography techniques to form circular vias at selected sites. Oxide layer 23 is then etched using wet chemistry [for example, using hydrofluoric acid (HF) as an etchant] where it has been exposed by the vias in the resist layer 27. This will result in the silicon substrate being exposed at the selected sites. The exposed portions of the silicon substrate are then etched anisotropically in the 100 crystallographic direction using the oxide layer 23 as an etch mask by, for example, potassium hydroxide. This directional etching will etch a via aperture 31 in the silicon, having a wall slope of about 55° from the surface defined by the interface between the silicon and the oxide layer 23. Etching will stop automatically at the oxide layer 22, leaving a precisely shaped via aperture 31 through the substrate.

The dimensions and shape of the portion of oxide layer 22 which is exposed through the vias 31 will be determined by the dimensions of the pattern etched in the oxide layer 23, taking into account the anisotropic nature of the etch through the substrate. In this connection, the size of the vias originally etched through the resist 27 is important, because it determines the ultimate size of the via 31.

With reference to FIG. 4*d*, the resist layer 26 is then patterned and exposed with holes much smaller than those formed in resist 27 (the drawings are not to scale), using photolithography or electron lithography. Metal layer 24 and layer 22 are then etched. The metal layer can be etched, for example, if the metal layer is a layer of chromium as aforesaid, by electrochemical etching using an electrolyte of 65 percent phosphoric acid, 15 percent sulfuric acid, and 20 percent water and about 15 volts across the cell. The oxide layer 22 is etched anisotropically with ion etching using, for example, trifluoromethane. Anisotropic etching will assure that the metal layer 24 is not undercut. Such undercutting would cause a discontinuity in the surface of the via 29 which would be detrimental to forming the ionizer cone in the manner described hereinafter.

It should be noted that an array of the vias 29 and 31 are formed. Each via 29 registers with a via 31 to provide an aperture or hole which extends all of the way through the structure. However, the vias 31 are many times larger than the vias 29, with the result that many vias 29 register with a via 31.

Any residual resist material used to form the layers 26 and 27 is then removed with, for example, toluene. A layer 32 of a closure material which is selectively etchable relative to the rest of the structure (e.g., aluminum oxide) is applied to the upper surface of the structure over the metal layer 24. It is applied by off-axis evaporation from above, as is represented by arrow 33 in FIG. 4*e* while the microelectronic structure is being rotated. This rotation will assure a generally uniform deposition of the evaporant on the exposed edges of the insulating layer 22 and metal layer 24. The deposition will terminate at such edges in a tapered manner as illustrated.

Another metal layer 33 is applied to a thickness in the range of about 2000 Å to 4000 Å to the structure to define the gas outlet. It is applied through aperture 31 from the side of the structure opposite that at which the gas outlet is to be defined. Again, it is applied by off-axis evaporation during rotation of the structure. This "backside", off-axis deposition is represented in FIG. 4*f* by arrow 34. Such deposition will result in a tapered metal formation 36 over the tapered edges of the closure material layer. It is this taper which defines the thin rim of the gas outlet that has been described.

After the layer 33 is applied, the closure material 32 is removed by, for example, etching. If the closure material is aluminum oxide, it can be removed without damage to the remaining structure by a 10 minute wet etch with potassium hydroxide. Removal of such material will result in the edges 36 of the gas outlet being free standing, as is illustrated in FIG. 4*g*, and spaced from the metal layer 24 which defines the counterelectrode. The insulating layer 22 is preferably then etched back so that the counterelectrode 24 will project outward into the aperture 31 to the gas outlet.

FIG. 4*h* illustrates in section the resulting ionizer structure. The gas outlet is a generally annular rim in shape and is constructed to have a diameter, the dimension represented at 37 in the figure, in the range of between about one-fourth and one micron, preferably one-half micron. It tapers to a self-supporting thickness of only about 500 Å. The gas outlet is spaced from the counterelectrode by about one-half micron. This spacing is represented in the figure by dimensional line 38. As mentioned previously, a voltage of only about 150 volts differential results in an electrostatic field at the rim of about $10^8$ V/cm. It also will be seen that the described method of construction results in the gas outlet and the counterelectrode structures being basically in the same plane. The result is that the buildup of contaminants due to sample material collecting on the counterelectrode is inhibited.

It will be recognized from the above that the invention lends itself readily to the batch processing of a full array of low voltage, field ionizers of the invention. Moreover, the microfabrication technology utilized for the invention is well developed, and its use results in precise duplication from one batch to another.

Figure 5:
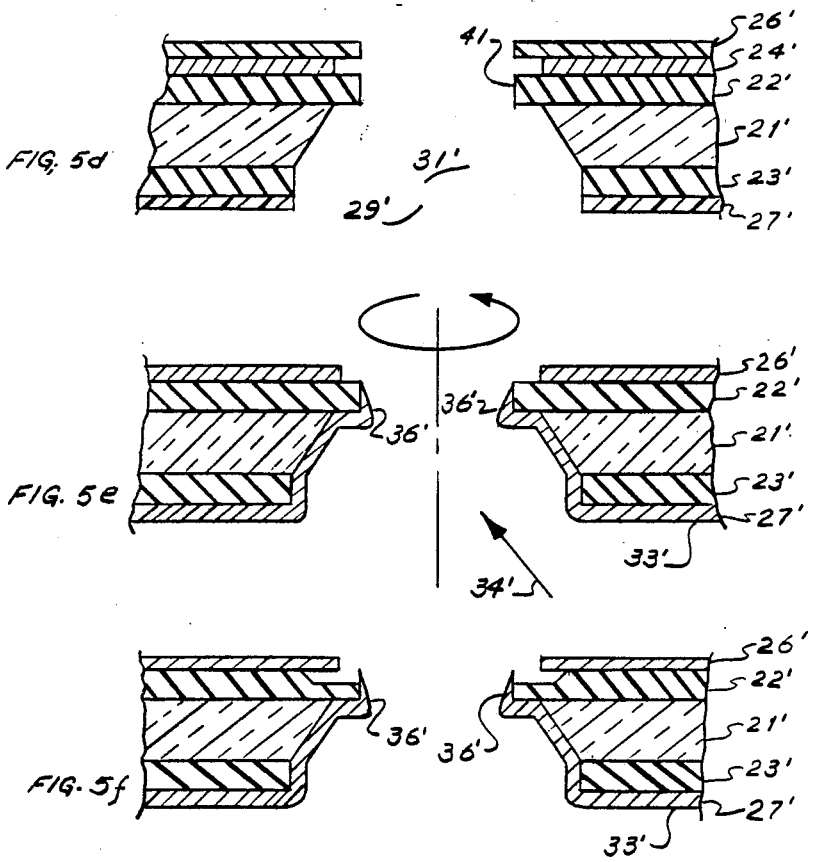
FIG. 5*d* to 5*f* are views of alternate steps in the fabrication method.

FIG. 5 shows an alternate procedure for forming the desired gas outlet. (Like portions of the gas outlet construction of FIG. 5 are referred to by the same reference numerals used in FIG. 4, except that they are primed.) The initial procedures represented by FIGS. 4*a*–4*d* and the accompanying description, are the same. After formation of the aperture 31' extending through the substrate, the metal layer 24' which is to form the counterelectrode is etched back as illustrated in 5*d* by, for example, electropolish etching for a nominal distance from the edge 41 of insulating layer 22' of about one-half micron.

Resist layers 26' and 27' are then removed as aforesaid, and a metal layer 33' is applied from the opposite side of the structure by off-axis evaporation in the same manner as layer 33 was applied. However, in this construction the tapered edges of the same to form the rim 36' of the gas outlet will be deposited on the edge 41 of the insulating layer 22'. This step and the resulting construction is illustrated in FIG. 5*e*. The insulating layer 22' is then slightly etched back at the metal edge to form a free-standing rim for the gas outlet as is represented in FIG. 5*f*. The desired ionizer is thus formed.

The dimensions of the ionizer fabricated with this alternate procedure are the same as those set forth above. It will be seen that use of this procedure eliminates the application of a closure material. However, the resulting gas outlet edge is not in the same plane as the counterelectrode.

Figure 6:
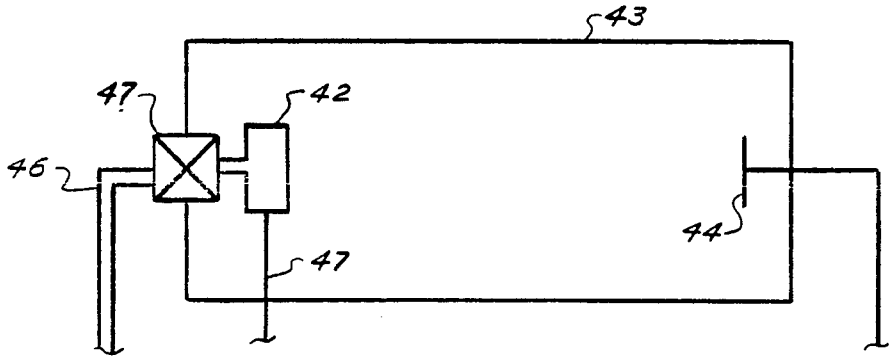
FIG. 6 is a representative schematic view of a mass spectrometer incorporating a microelectronic field ionizer of the invention.

The ionizer of the invention is particularly useful as an ion source in an ion mobility spectrometer due to its tolerance of atmospheric pressures. FIG. 6 illustrates such an arrangement. An ion source array of the invention, schematically illustrated at 42, is provided at one end of a chamber 43 which contains a gas inert to the ions to be created, e.g., nitrogen. An electrode 44 is installed in the chamber at its other end, and a potential difference is created between the ion source and such electrode to cause ions issuing from such source to travel to the electrode. The gas to be analyzed is introduced to the ionizer for flow through the gas outlets of the array and consequent ionization. This gas flow introduction and its control is represented in FIG. 6 by conduit 46 and valve 47.

As mentioned previously, a significant advantage of the instant invention is that ions can be formed independent of the pressure of the ambient atmosphere of such ionizer. The pressure of the inert gas in chamber 43 is maintained at a pressure slightly above that of the pressure surrounding the chamber, with the result that contaminating leakage problems are avoided and it is not necessary that expensive and awkward vacuum equipment be included to maintain a high vacuum for the ion source. It therefore will be seen that the incorporation of a microelectronic field ionizer of the invention into an ion mobility chamber results in the latter being improved highly. Although this aspect of the ionizer of the invention is particularly cogent, it will be recognized by those skilled in the art that the invention has other aspects which make it particularly desirable for other uses. It is intended that the coverage afforded applicant be limited only by the claims and their equivalent language.

What I claim is:

1. A microelectronic field ionizer comprising a planer substrate; means at a surface of said substrate defining a gas outlet, said means defining said gas outlet being capable of maintaining a first electric potential at said outlet; and a first electrically conductive material on said substrate spaced but adjacent said outlet providing a counterelectrode for a second, different electric potential to create an electrostatic field at said outlet for ionizing gas thereat.

2. The microelectronic field ionizer of claim 1 wherein the edge of said gas outlet is generally annular and has a thickness of less than about 500 Å, and said outlet has a diameter of about one-half micron.

3. The microelectronic field ionizer of claim 1 wherein the closest spacing between any portion of said means defining said gas outlet and said first conductive material providing said counterelectrode is greater than the distance necessary to cause an electrical breakdown when said ionizer is operating between said means and said material at the pressure of gases within said spacing.

4. The microelectronic field ionizer of claim 3 further including a potential source for applying a potential difference between said means and said material which, is less than that necessary at said closest spacing to cause an electrical breakdown as aforesaid, irrespective of the pressure of the gases within said spacing.

5. The microelectronic field ionizer of claim 3 wherein said spacing is in the range of between one-tenth and one micron.

6. The microelectronic field ionizer of claim 1 wherein a passage for gas to be ionized extends through said substrate from a second surface thereof to the one at which said gas outlet is defined.

7. The microelectronic field ionizer of any of the previous claims wherein said means defines an array of said gas outlets at said substrate surface, and said electrically conductive material is a layer of said material having apertures which register with each of said outlets to thereby provide respectively for each of the same, a counterelectrode for a second, different electric potential to create electrostatic fields at the gas outlets of said array for ionizing gas thereat.

8. A method of fabricating a field ionizer comprising the steps of:

A. Providing a planer microelectronic substrate;

B. Forming a gas outlet at one surface of said substrate capable of maintaining a first electric potential; and C. Applying a first electrically conductive material to said substrate spaced but adjacent said gas outlet capable of maintaining a second, different potential.

9. The method of claim 8 of fabricating a field ionizer wherein said planer substrate is a semiconductive material, further including the step of forming an insulating layer between it and said electrically conductive material.

10. The method of claim 8 for fabricating a field ionizer wherein said step of forming a gas outlet at said surface of said substrate comprises the steps of forming an aperture through said substrate to said surface at the location desired for said gas outlet; and forming through said aperture with a second electrically conductive material, a gas outlet at said one surface of said substrate having a diameter in the range of between 0.1 and 1 microns and a generally annular edge having a thickness of less than about 1,000 Å.

11. The method of claim 10 for fabricating a field ionizer wherein said gas outlet is formed by applying said second electrically conductive material through said aperture from a surface opposite the surface thereof at which said gas outlet is desired.

12. The method of claim 10 of fabricating a field ionizer wherein said step of forming said gas outlet further comprises the steps of forming an insulating layer on said surface of said substrate between said first material and said substrate; forming a via through said first material and said insulating layer in registration with said aperture in said substrate; applying a removable closure material at said via over said insulating layer and said first electrically conductive material; applying a second electrically conductive material to said closure material through said aperture extending through said substrate; and thereafter removing said closure material to expose said first electrically conductive material and form a free-standing, generally thin edge of said second electrically conductive material at said gas outlet.

13. The method of claim 10 of fabricating a field ionizer wherein said step of forming said gas outlet further comprises the steps of forming an insulating layer on said surface of said substrate between said first material and said substrate; forming a via through said first material and said insulating layer in registration with said aperture in said substrate; removing said first material from adjacent the edges of said insulating layer at said via; and applying a second electrically conductive material through said aperture to said edges of said insulating layer; and thereafter removing a portion of said insulating layer at said edge to form a free-standing, generally thin edge of said second electrically conductive material at said gas outlet.

14. The method of any of the previous claims of fabricating a field ionizer wherein an array of said field ionizers are provided on a single substrate, each of which has a gas outlet and in which said first electrically conductive material is a layer of material on said substrate.

15. In a field ionizer having a structure defining a gas outlet that is capable of maintaining a first electrical potential at said outlet and a counterelectrode adjacent said outlet capable of maintaining a second different electrical potential for ionizing gas at said outlet, the improvement comprising a layer of conductive material providing said counterelectrode on the same structure as that defining said gas outlet.

* * * * *